US006301792B1

(12) United States Patent
Speer

(10) Patent No.: US 6,301,792 B1
(45) Date of Patent: Oct. 16, 2001

(54) RECHARGEABLE SHAVING APPARATUS FOR VEHICLE

(76) Inventor: Roger D. Speer, Box 204, Dighton, KS (US) 67839

( * ) Notice: Subject to any disclaimer, the term of this patent is extended or adjusted under 35 U.S.C. 154(b) by 0 days.

(21) Appl. No.: 09/491,219

(22) Filed: Jan. 25, 2000

(51) Int. Cl.[7] ..... B26B 19/38
(52) U.S. Cl. ..... 30/541; 30/537
(58) Field of Search ..... 30/537, 541, 500; 206/351

(56) References Cited

U.S. PATENT DOCUMENTS

| | | | | |
|---|---|---|---|---|
| D. 300,626 | | 4/1989 | Crutcher et al. . | |
| 3,043,996 | * | 7/1962 | Hartwig et al. | 30/541 X |
| 3,896,364 | | 7/1975 | Reister . | |
| 4,094,486 | | 6/1978 | Sunderlin . | |
| 4,242,799 | | 1/1981 | Kameyama . | |
| 4,789,361 | | 12/1988 | Kinzalow et al. . | |
| 5,318,356 | * | 6/1994 | Shelton | 30/541 X |
| 5,355,273 | | 10/1994 | Yoshizawa et al. . | |
| 5,599,204 | | 2/1997 | Glassford . | |
| 5,865,403 | | 2/1999 | Covell . | |

* cited by examiner

*Primary Examiner*—Douglas D. Watts
(74) *Attorney, Agent, or Firm*—Dale J. Ream

(57) ABSTRACT

A rechargeable shaver for a vehicle comprises a shaver and a base member. The shaver includes a body portion having an ergonomic configuration for efficient use while driving. The shaver includes a shaving head having a cutting apparatus at one end and a generally circular surface normal to an opposing end for supporting the side of a user's hand during use. The shaver includes a rechargeable battery coupled to a male connector which extends through the support surface. The base member includes a socket which releasably mates with the male connector when the shaver is placed upon the base member. The socket is coupled to an electrical connector assembly for connecting the socket to a vehicle electrical receptacle for recharging the battery. The shaver may be actuated with an on/off button positioned on the body or, in an alternative embodiment, automatically upon removing the shaver from the base member.

16 Claims, 10 Drawing Sheets

RECHARGEABLE SHAVING APPARATUS FOR VEHICLE

BACKGROUND OF THE INVENTION

This invention relates generally to shavers for vehicles and, more particularly, to a rechargeable shaver and adjustable holder for use in over-the-road trucks.

Drivers of over-the-road trucks often work and sleep in their trucks away from modern conveniences for days at a time. In addition, delivery schedules often make it undesirable to take time to find a public restroom for the purpose of shaving. A battery operated portable shaver is only useful in this context so long as its battery retains a charge.

Various devices have been proposed in the prior art for adapting electric shavers for use in a vehicle, such as the apparatus disclosed in U.S. Pat. No. 4,242,799 to Kameyama. A rechargeable electric razor is proposed in U.S. Pat. No. 3,896,364 to Reister. These devices, however, are not adapted for easy grasping by a user for one handed use while driving. Further, the existing devices are not adapted to be held in a recharging base unit that is mounted within a semi-truck cab for convenient removal, placement, and storage of the shaver while recharging.

Therefore, it is desirable to have a rechargeable shaver having a configuration that is easy to grasp and hold with one hand while driving. Further, it is desirable to have a shaver which includes a holder that is pivotally adjustable to facilitate use while driving. It is also desirable to have a shaver which can be easily coupled to or removed from a recharging base unit with one hand while driving without significantly impairing driving ability.

SUMMARY OF THE INVENTION

The rechargeable shaving apparatus constructed in accordance with the present invention includes a shaver having an ergonomically configured body portion with first and second ends. The body portion includes an outwardly tapered surface between the first and second ends for supporting the thumb of a user's hand while gripping the body portion. The second end of the body portion forms a generally circular surface for supporting the side of a user's hand while gripping the body portion. A shaving head is coupled to the first end of the body portion and is configured to cut the hairs on a skin surface during shaving. A rechargeable battery is positioned within the body portion of the shaver and is electrically connected to a male connector extending through the second end of the body portion.

The shaving apparatus includes a base unit for holding and recharging the shaver. The base unit includes a mounting bracket for mounting the base unit to the dashboard or other suitable surface within a vehicle. A holder is pivotally attached to the bracket for selectively positioning the apparatus. The holder includes a bottom wall bounded by a rim for retaining the shaver therein. A socket also extends upwardly from the bottom wall for releasably mating with the male connector when the shaver is placed on the holder. The socket is connected to an electrical adapter which can be plugged in to a vehicle electrical power source, such as a cigarette lighter receptacle. Accordingly, the shaver battery is recharged when the shaver is retained in the holder, i.e. when the male connector is coupled to the socket.

In a preferred embodiment, the cutting head is energized by a user pressing an on/off button on the side of the body portion. A release of the button deactivates the cutting head. The position of the button on the thumb support enables the button to be depressed by merely grasping the body portion. In an alternative embodiment, the cutting head is automatically actuated upon removing the shaver from the base unit.

Therefore, a general object of this invention is to provide a shaving apparatus for a vehicle having a shaver and a recharging base unit.

Another object of this invention is to provide a shaving apparatus, as aforesaid, wherein the shaver presents a configuration that is easily graspable by a user.

Still another object of this invention is to provide a shaving apparatus, as aforesaid, in which the base unit is configured to be mounted to a horizontal, vertical, or inclined surface and pivotally adjustable such that the shaver is vertically disposed when placed in the base unit.

Yet another object of this invention is to provide a shaving apparatus, as aforesaid, in which the base unit is connected to a vehicle electrical source.

A further object of this invention is to provide a shaving apparatus, as aforesaid, in which the shaver includes a rechargeable battery which is recharged when the shaver is coupled to the base unit.

A still further object of this invention is to provide a shaving apparatus, as aforesaid, which may be automatically actuated when removed from the base unit.

A particular object of this invention is to provide a shaving apparatus, as aforesaid, which includes a thumb rest for relieving tension on a user's hand while shaving.

Another object of this invention is to provide a shaving apparatus, as aforesaid, that is economical to manufacture and durable in construction.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 8:
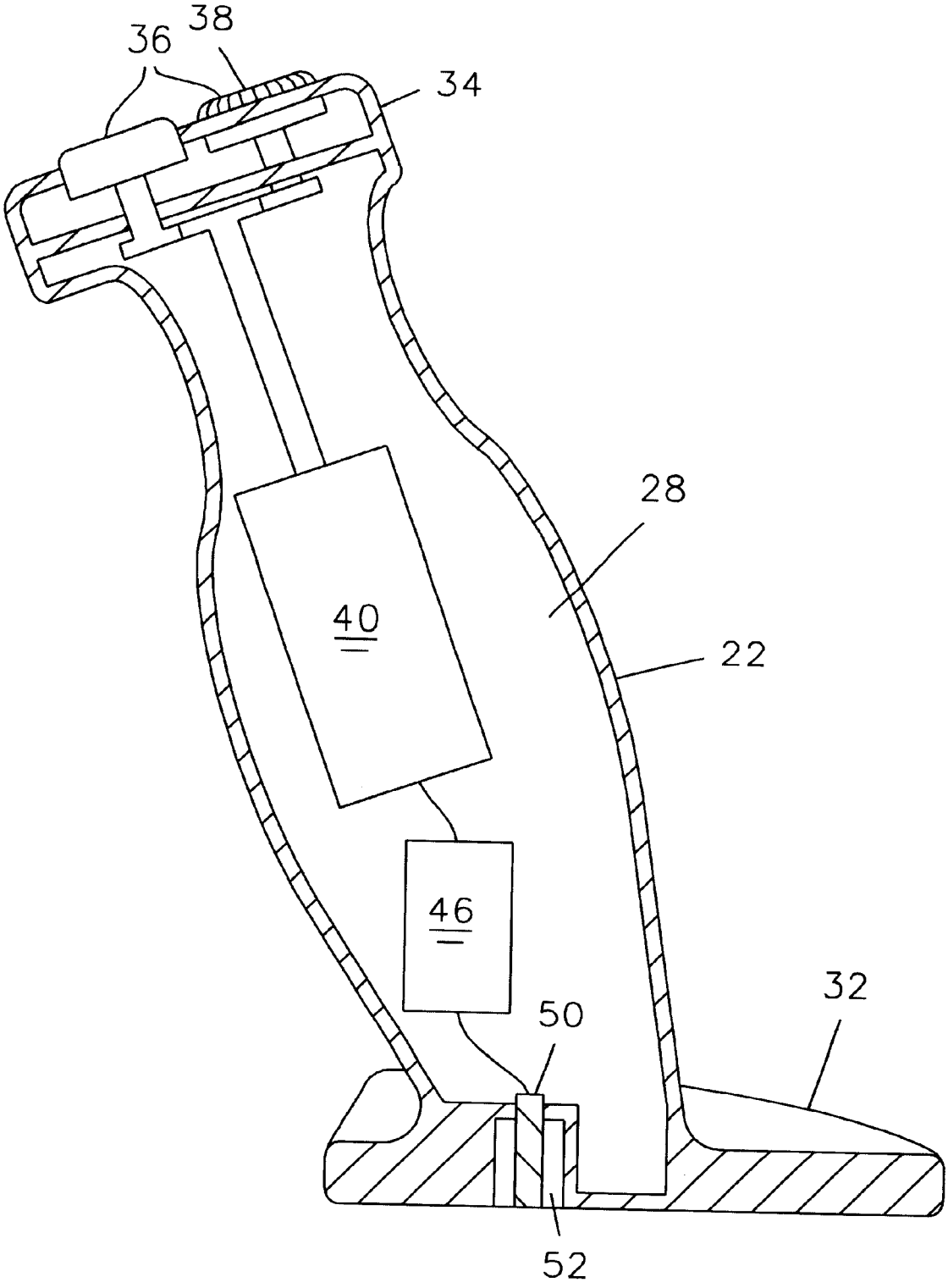
FIG. 8 is a section view of the shaver taken along line 8—8 of FIG. 7.

A shaving apparatus 10 constructed in accordance with a preferred embodiment of the present invention is shown in FIGS. 1–4, 7, and 8. The shaving apparatus 10 includes a shaver 20 and a recharging base unit 60. The shaver 20 includes an ergonomically configured body portion 22 with first 24 and second 26 ends and which defines an internal cavity 28 (FIG. 8). The body portion 22 includes an outwardly tapered support surface 30 intermediate the first 24 and second 26 ends which slopes downwardly toward the second end 26. It is understood that the tapered surface 30 is only formed along one side of the body portion 22 and is particularly adapted to support the thumb of a user's right hand while holding the shaver during use. A second support surface 32 is normal to the body portion 22 at the second end 26 thereof. The second support surface 32 extends opposite the tapered support surface 30 and is configured to support the outer portion of a user's right hand while grasping the body portion 22 of the shaver 20.

Figure 10:
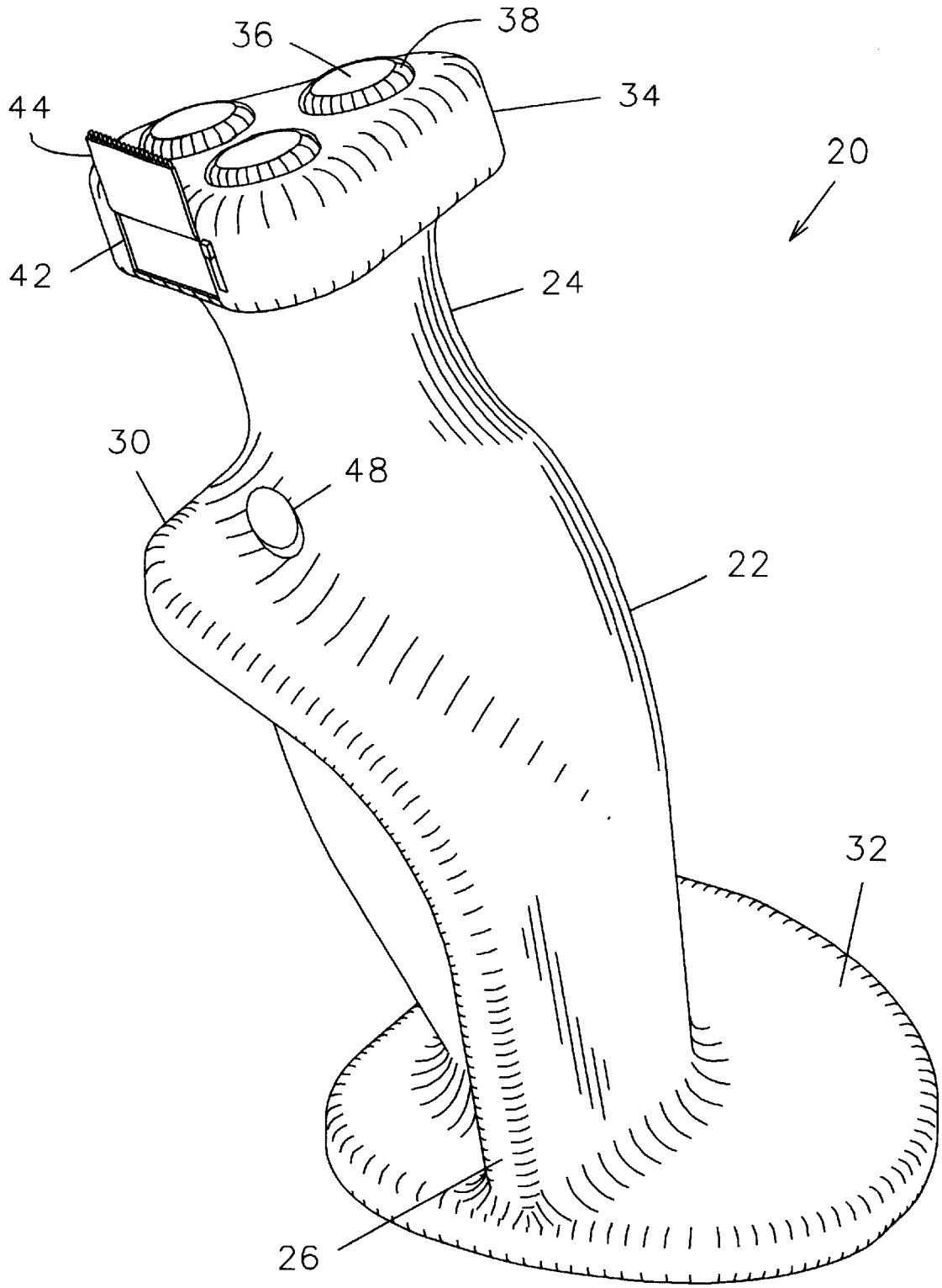
FIG. 10 is a perspective view of the shaver as in FIG. 1 on an enlarged scale with the trimmer in an extended position.

The shaver 20 further includes a cutting head 34 coupled to the first end 24 of the body portion 22. At least one planar disc 36 is mounted in said cutting head 34, each disc having a plurality of apertures 38 for receiving facial hairs therethrough. The apertures 38 are bounded by sharp edges for slicing the hair upon rotation of the disc. The discs 36 are coupled to a motor 40 mounted within the cavity 28 of the body portion 22. The motor is electrically connected to a rechargeable battery 46 mounted within the cavity 28 of the body portion 22 of the shaver 20. As best shown in FIG. 10, the cutting head 34 also includes a beard trimming apparatus 42 having a slidable trimmer 44. Although a rotary disc cutting head 34 is shown, other types of cutting heads, such as single edge foil screen cutting heads, would also be suitable.

An on/off button 48 is mounted to the tapered surface 30 of the body portion 22 and extends therethrough into the cavity 28. A depression or release of the button 48 by a user closes or opens, respectively, a circuit between the battery 46 and cutting head 34 for selectably energizing the cutting head 34. The position of the button 48 on the tapered surface 30 facilitates depression thereof by a user's thumb when a user grasps the body portion 22 while shaving. It is understood that the tapered surface 30 and on/off button 48 could extend from the other side of the body portion 22 so as to be configured for use with the left hand, such as would be necessary for use in vehicles used in many foreign countries. A pair of electrical contact members are electrically connected to the battery 46 to form a male connector 50 which extends into a recess 52 formed in the second support surface 32 to facilitate recharging of the battery 46 (FIG. 2), as to be described more fully below.

The rechargeable base unit 60 includes a holder 72 pivotally coupled to a mounting bracket 62. The mounting bracket 62 comprises a plate having a pair of spaced apart apertures 64 through which screws may be inserted for mounting the bracket 62 to a dashboard or other vehicle surface. A hinge assembly 66 integrally extends from the plate and includes a cylindrical bore 68 having recessed ends for receiving a bolt/nut combination therein. The hinge assembly 66 includes a pair of cutaway sections corresponding to a pair of mounting tabs 74 extending from the holder 72. Therefore, the holder 72 is secured to the mounting bracket 62 by aligning apertures 64 in the tabs 74 with the bore 68 and inserting a bolt therethrough. When the holder 72 has been pivotally adjusted to a desired position, the bolt/nut combination is tightened to hold the holder 72 firmly in place.

The holder 72 includes a bottom wall 76 bounded by a rim 78. The bottom wall 76 and rim 78 present a configuration complementary to the configuration of the second support surface 32 such that the shaver 20 is retained in the holder 72 by placing the second support surface 32 against the bottom wall 76 bounded by the rim 78. It is understood that the second support surface 32, bottom wall 76, and rim 78 have complementary irregular configurations such that the shaver 20 only fits into the holder 72 a single way.

A socket 80 is mounted to the bottom wall 76 of said holder 72 and is positioned to mate with the male connector 50 of the shaver 20 when the shaver 20 is retained in the holder 72. The socket 80 extends within the recess 52 as the shaver 20 is downwardly placed onto the holder 72.

The shaving apparatus 10 further includes an electrical adapter 82 having a tubular casing suitable to be inserted into a vehicle cigarette lighter receptacle. A positive contact member 84 extends from a free end of the adapter 82. A negative contact member 86 in the form of an arcuate spring protrudes laterally outwardly of one side of the adapter 82. An arcuate retention spring 88 protrudes from an opposed side of the adapter 82. An electrical cord 90 connects the adapter 82 with the socket 80.

In use, the base unit 60 of the shaving apparatus is mounted in the interior of a vehicle by inserting screws through the bracket plate apertures 64 and into a desired interior surface. Once the holder 72 has been pivoted to a desired position, the holder 72 is secured with a bolt/nut combination. It is seen that the adjustability of the base unit 60 allows the shaver to be in an upright position regardless of where the base unit 60 is mounted. The shaver 20 is retained in the holder 72 when not in use. The male connector 50 in the shaver 20 mates with the socket 80 in the base unit 60 when the shaver 20 is placed thereon such that the battery 46 is recharged. Since there is only one way to place the shaver 20 in the holder 72, a driver may easily remove the shaver 20 for shaving and replace the shaver 20 in the holder 72 for recharging with one hand while driving. The adapter 82 may remain plugged in to the cigarette lighter receptacle or may be removed as desired.

Figure 1:
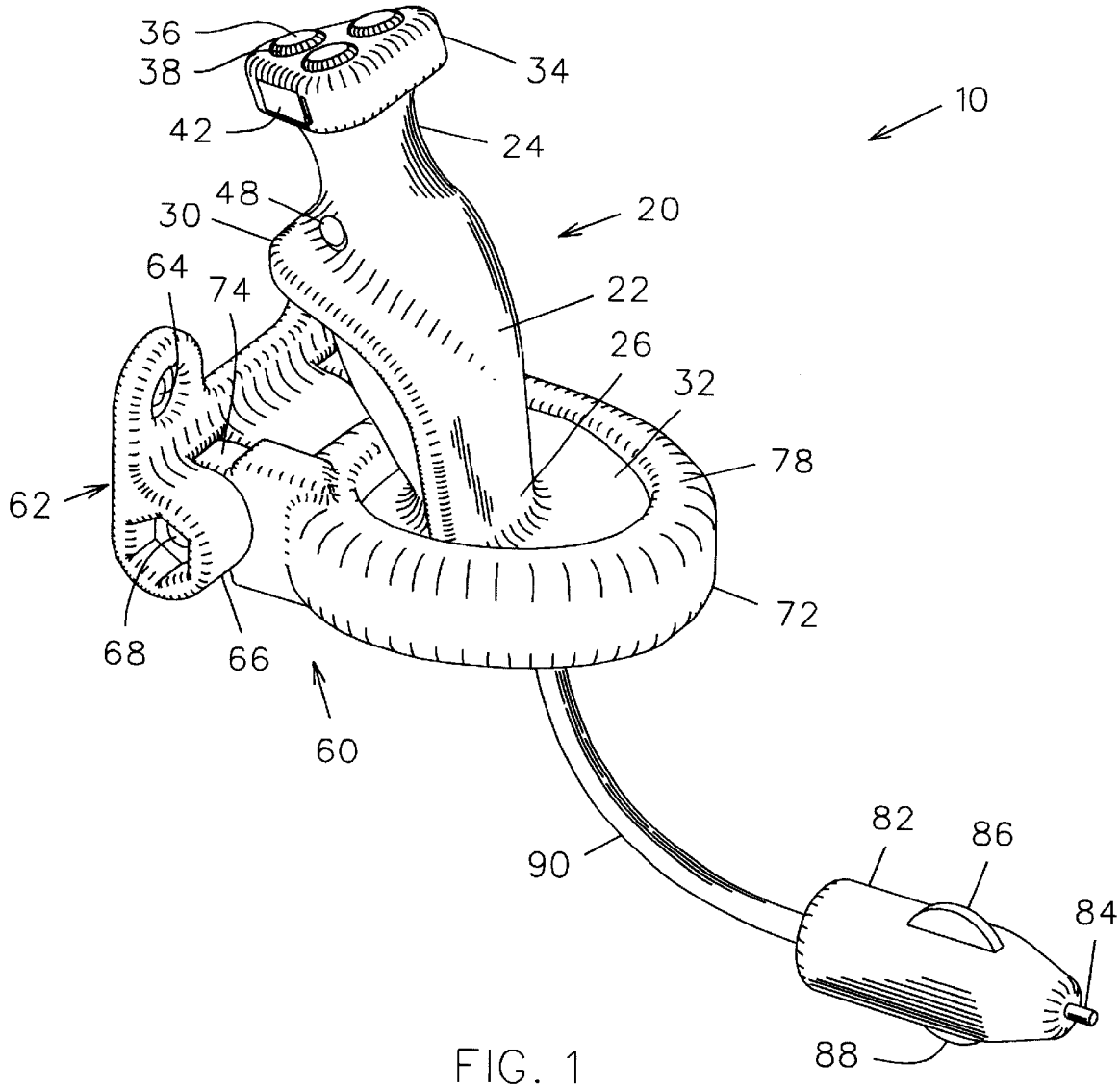
FIG. 1 is a perspective view of the shaving apparatus according to the preferred embodiment of the present invention.
Figure 2:
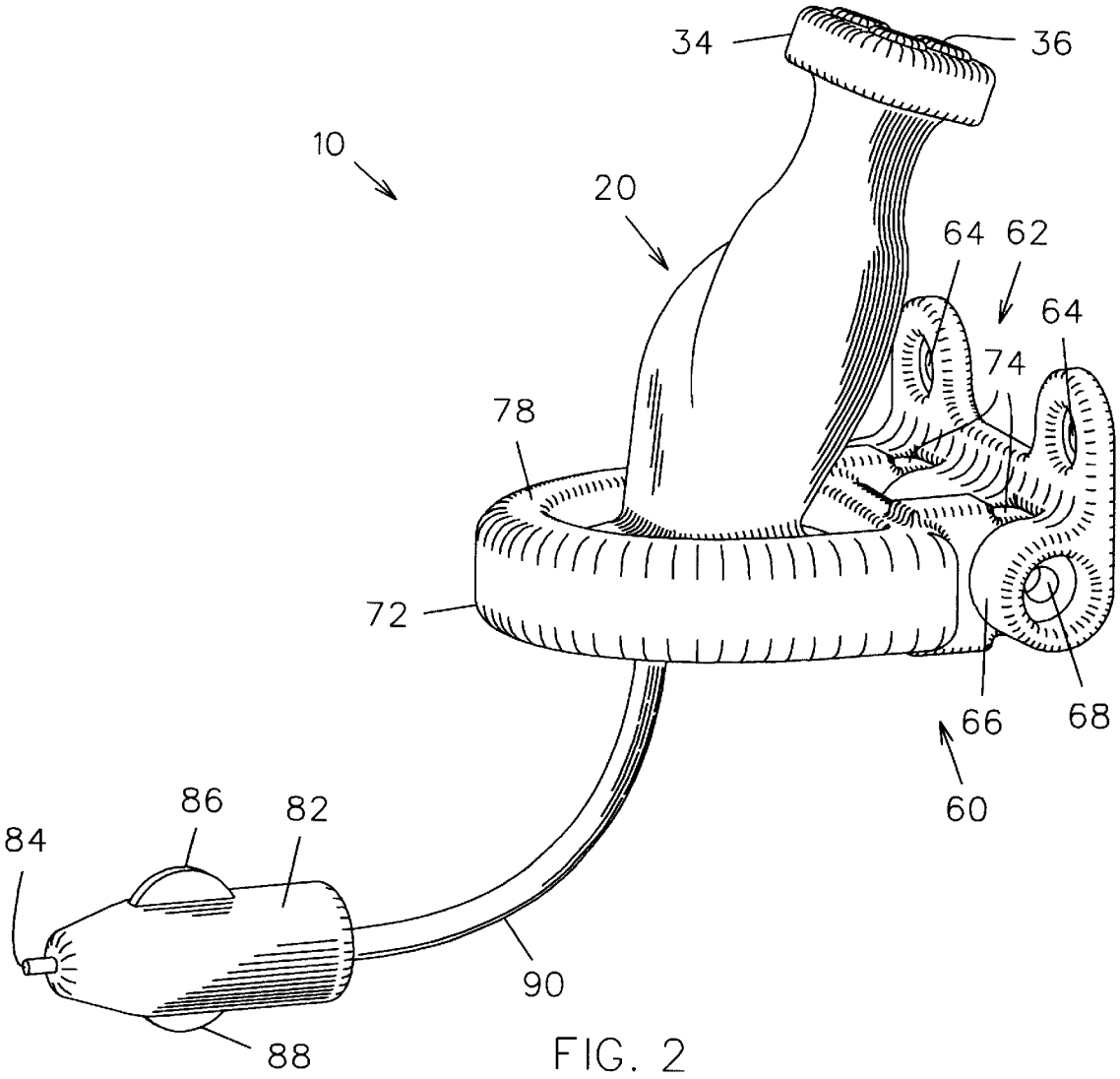
FIG. 2 is a perspective view of the shaving apparatus as in FIG. 1.
Figure 3:
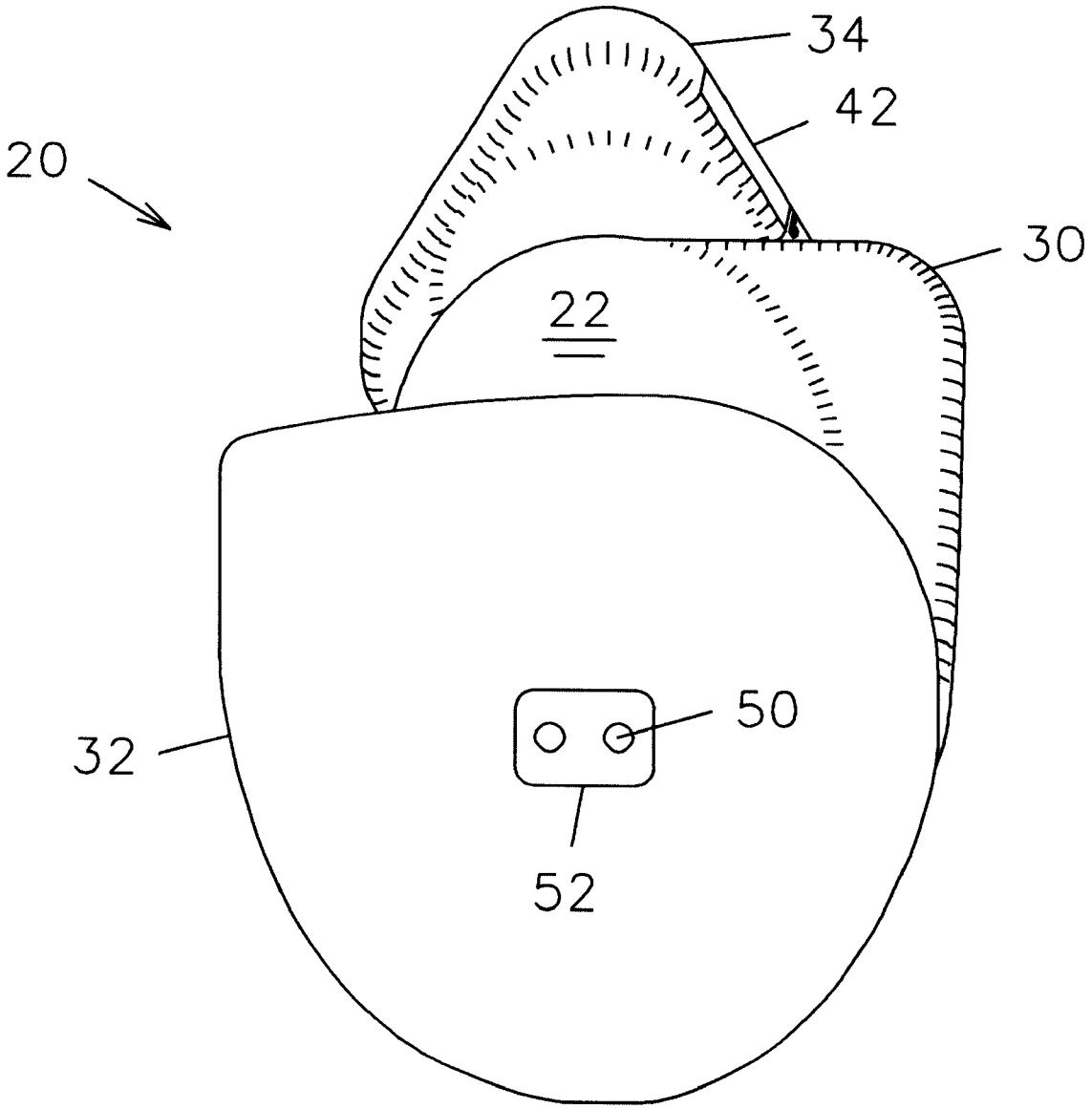
FIG. 3 is a bottom view of the shaving apparatus as in FIG. 1.
Figure 4:
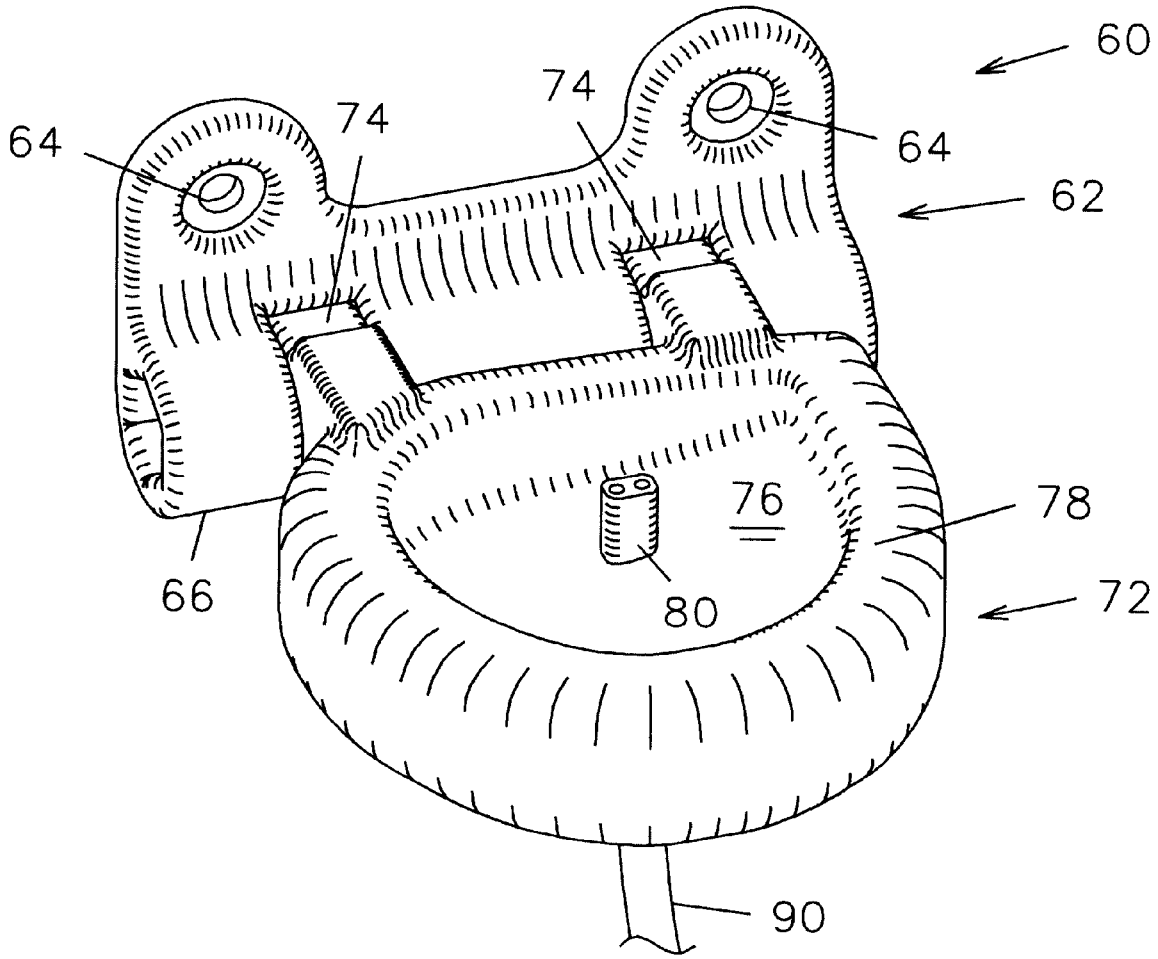
FIG. 4 is a perspective view of the base unit.
Figure 5:
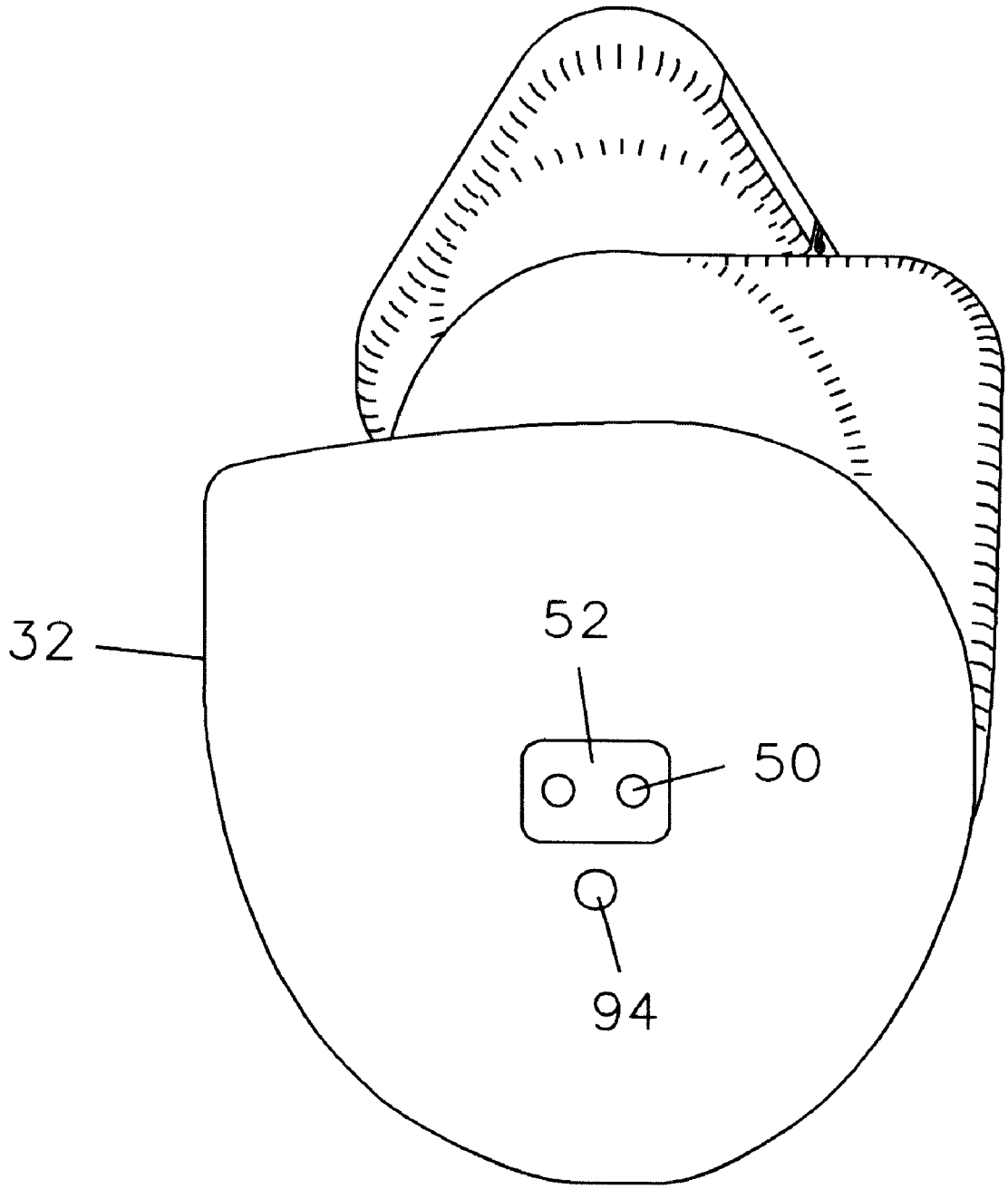
FIG. 5 is a bottom view of an alternative embodiment of the shaving apparatus.
Figure 6:
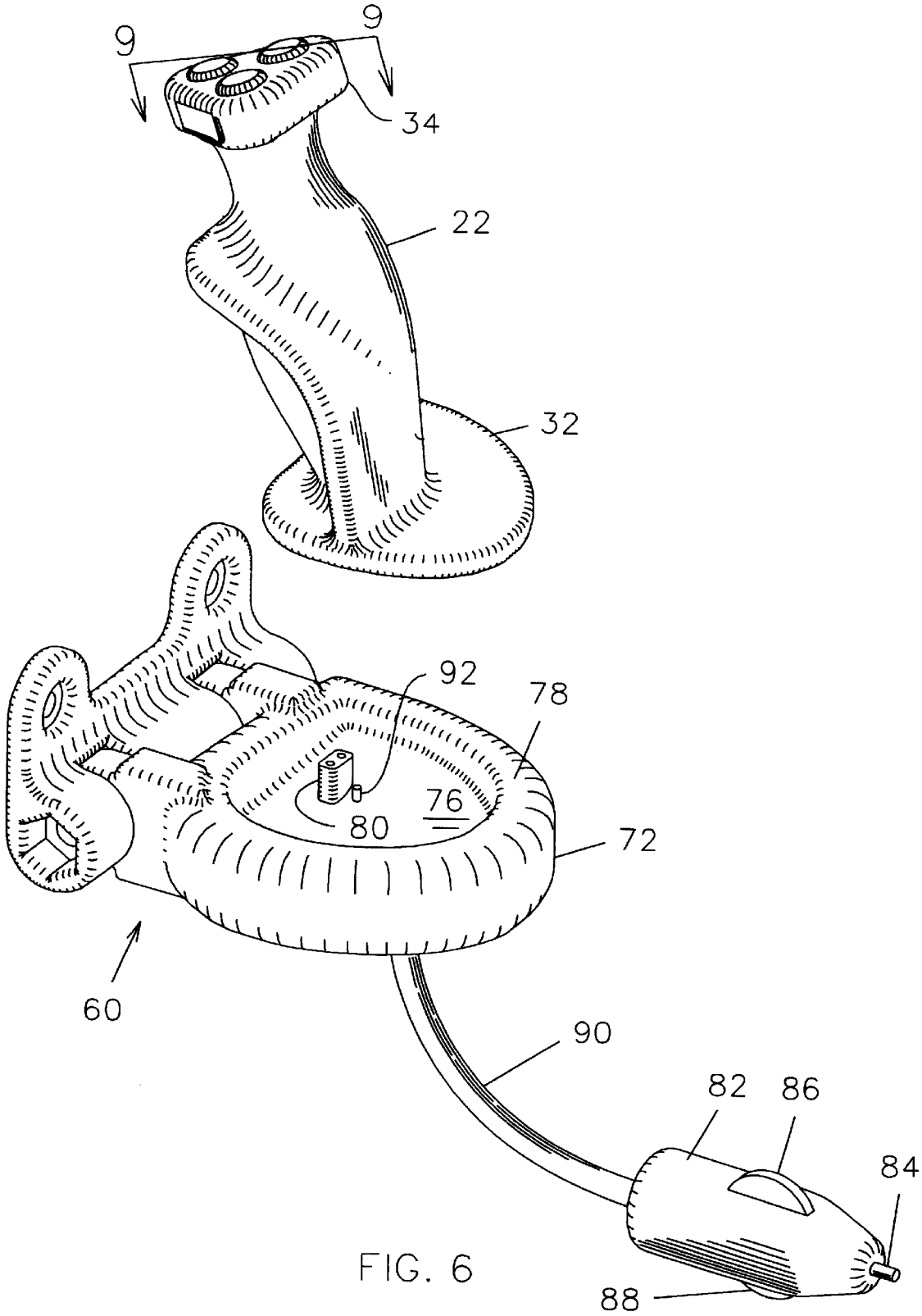
FIG. 6 is a perspective view of the alternative embodiment of the shaving apparatus as in FIG. 5.
Figure 7:
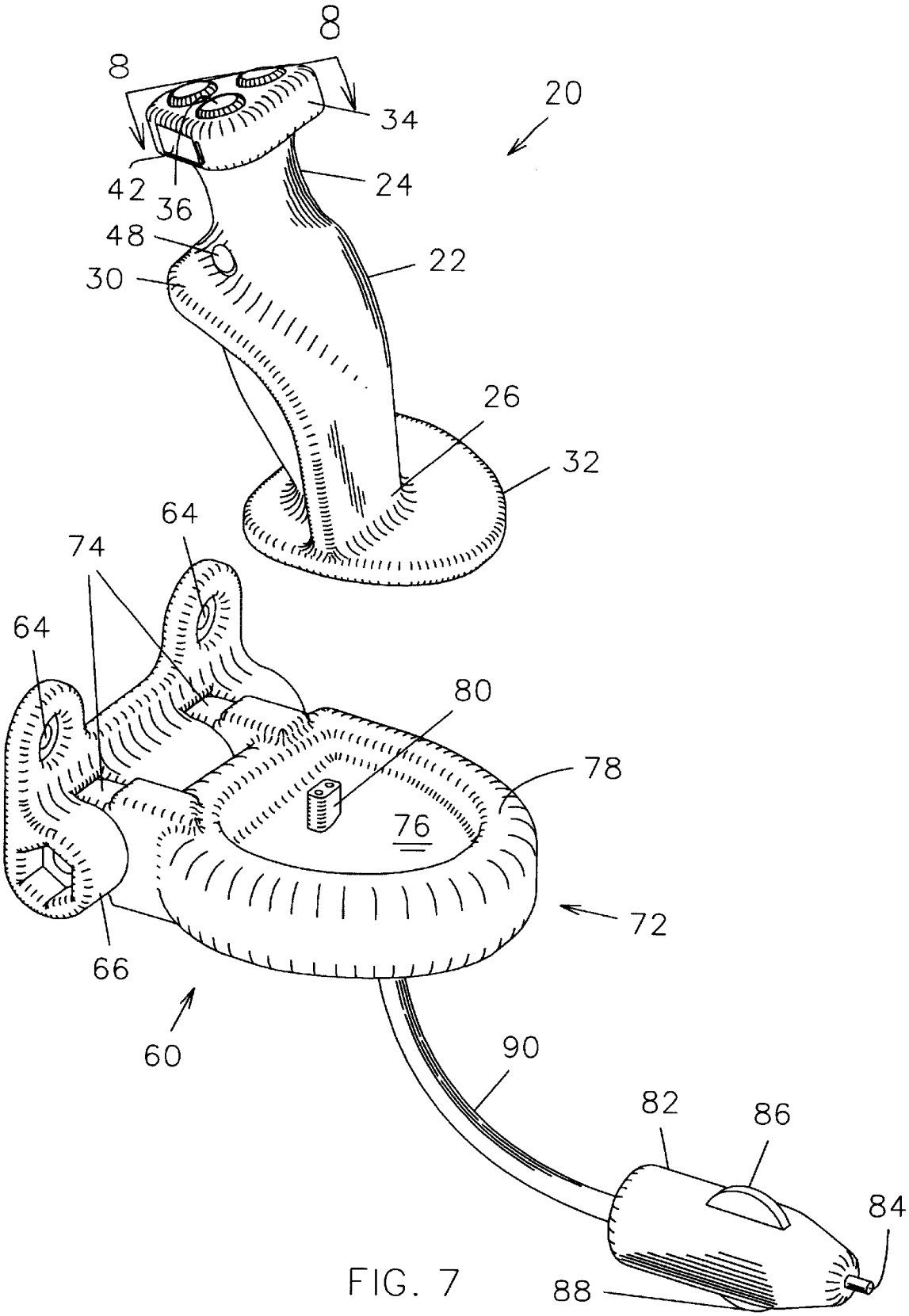
FIG. 7 is an exploded view of the shaving apparatus as in FIG. 1.
Figure 9:
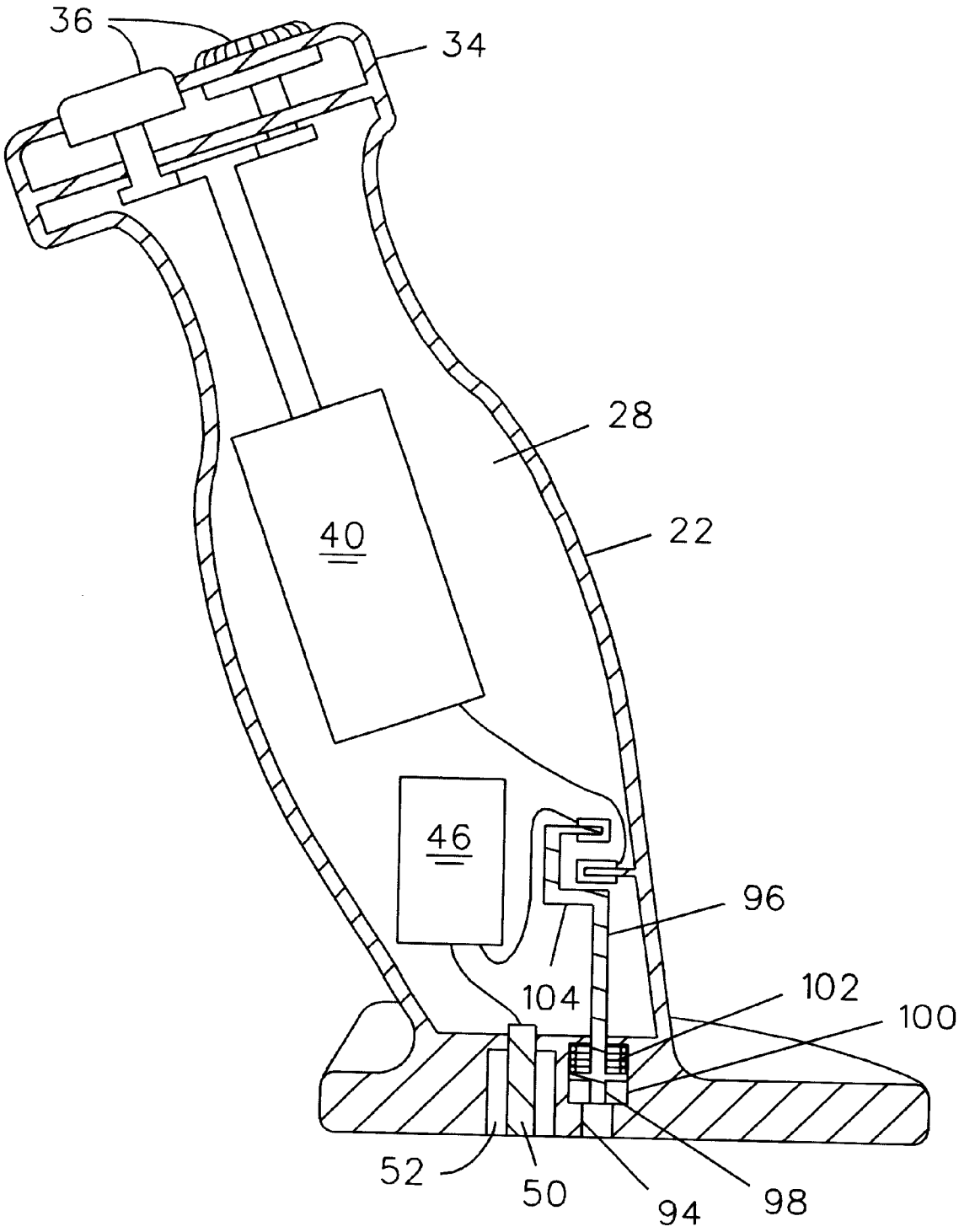
FIG. 9 is a section view of the alternative embodiment of the shaver taken along line 9—9 of FIG. 6.

An alternative embodiment of the shaving apparatus is shown in FIGS. 6 and 9 and is substantially similar to the embodiment previously described except as particularly noted below. The alternative embodiment of the shaving apparatus does not include an on/off button on the body portion 22. A hub 92 extends from the bottom wall 76 of the holder 72 adjacent the socket 80. A bore 94 extends through the second support surface 32 of the body portion 22 of the shaver 20 adjacent the recess 52. A lower end 98 of a rod 96 is slidably mounted within a chamber 100 which is in communication with the bore 94, the chamber 100 including a compression spring 102 and the rod 96 extending into the cavity 28. An upper end 104 of the rod 96 forms a circuit with the battery 46 and cutting head motor 40. When the shaver 20 is placed on the holder 72, the hub 92 extends into the bore 94 and pushes the rod 96 upward into the cavity 28, causing the spring 102 to compress and the upper end 104 of the rod 96 to open the circuit (FIG. 9). Conversely, when the shaver 20 is removed from the holder 72, the spring 102 returns the rod 96 to an unbiased position which closes the circuit to energize the motor 40. Therefore, the cutting head 34 is automatically activated when the shaver 20 is removed from the base unit 60 and is deactivated when the shaver 20 is again placed thereon.

Accordingly, it is seen that the shaving apparatus of the present invention provides a rechargeable shaver that can be mounted on or removed from its recharging base unit or used for shaving with one hand by the driver of a vehicle without significantly impairing driving ability.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A rechargeable shaver for use in a vehicle, comprising:

a body portion having first and second ends and defining an interior cavity, said body portion presenting an outwardly tapered support surface intermediate said first and second ends;

a shaving head coupled to said first end of said body portion;

at least one planar disc movably mounted in said cutting head and having a plurality of apertures therethrough bounded by sharp edges;

a motor positioned in said body portion and coupled to said disc for moving said disc upon a user actuation thereof such that said sharp edges slice through hairs projecting through said apertures from a skin surface;

a rechargeable battery positioned within said interior cavity of said body portion and electrically connected to said cutting means;

a pair of contact members electrically connected to said battery and extending through said second end of said body portion;

means on said body for actuating said cutting means;

a base member having a socket for releasably mating with said pair of contact members;

an electrical connector assembly depending from said base member including connection means for electrically connecting said socket with a vehicle power source for recharging said battery when said contact members of said body portion are coupled to said socket of said base member.

2. A rechargeable shaver as in claim 1 wherein said electrical connector assembly comprises:

a cylindrical body adapted for insertion into an electrical receptacle in the vehicle;

a positive contact member extending from an operative end of said body;

a negative contact member extending from a side of said body; and a wire conductor extending from an opposite end of said body and coupled to said socket of said base member for electrically connecting said socket with said receptacle when said body is inserted therein.

3. A rechargeable shaver as in claim 2 wherein said base member includes:

a bracket adapted for mounting to a vehicle surface;

a holder pivotally attached to said bracket, said holder including a bottom wall bounded by a rim, said rim having a configuration complementary to a configuration of said second end of said body portion for selectably retaining said second end within said rim.

4. A rechargeable shaver as in claim 3 wherein said socket extends from said bottom wall whereby said contact members mate with said socket when said second end of said body portion is retained within said rim.

5. A rechargeable shaver as in claim 4 wherein said actuating means comprises a button positioned on said body portion, said button being electrically connected to said battery upon depression thereof for selectively energizing said cutting means.

6. A rechargeable shaver as in claim 5 wherein said actuating means comprises:

a hub extending from said base member;

a bore extending through a bottom of said body portion, said hub extending through said bore when said contact members mate with said socket;

an electrical circuit including said battery and said cutting means;

a rod movably mounted in said bore and having an open position precluding a current delivery from said battery to said cutting means and a closed position for current delivery from said battery to said cutting means, said rod being at said open position upon said hub mating with said bore and at said closed position upon separation of said hub from said bore.

7. A rechargeable shaver for use in a vehicle, comprising:

a body portion having first and second ends and defining an interior cavity, said body portion having a tapered surface intermediate said first and second ends, said second end forming a generally circular surface normal to said body portion;

a cutting means at said first end of body portion;

a rechargeable battery positioned within said interior cavity of said body portion and electrically connected to said cutting means;

a male connector electrically coupled to said battery and extending through said second end of said body portion;

means on said body portion for actuating said cutting means;

a base member adapted to hold said body portion, said base member including a socket for selectably mating with said male connector;

an electrical connector assembly depending from said base member for electrically connecting said socket with a vehicle power source for recharging said battery when said male connector is coupled to said socket; and wherein said base member includes:

a mounting member; and a holder pivotally attached to said mounting member, said holder including a bottom wall bounded by a rim about the circumference thereof, said rim having a configuration complementary to a configuration of said second end of said body portion for selectably retaining said second end within said rim.

8. A rechargeable shaver as in claim 7, wherein said cutting means comprises:

a shaving head coupled to said first end of said body portion;

at least one planar disc movably mounted in said head and having a plurality of apertures therethrough bounded by sharp edges; and a motor positioned in said body and coupled to said disc for rotating said disc upon a user actuation thereof such that said sharp edges slice through hairs projecting through said apertures upon contact with a skin surface.

9. A rechargeable shaver as in claim 7 wherein said electrical connector assembly comprises:

a cylindrical body adapted for insertion into an electrical receptacle in the vehicle;

a positive contact member extending from an operative end of said body;

a negative contact member extending from a side of said body; and a wire conductor extending from an opposite end of said body and coupled to said socket of said base member for electrically connecting said socket with said electrical receptacle when said body is inserted therein.

10. A rechargeable shaver as in claim 7 wherein said socket extends from said bottom wall whereby said male connector mates with said socket when said second end of said body portion is retained within said rim.

11. A rechargeable shaver as in claim 7 wherein said actuating means comprises a button positioned on said body portion adjacent said tapered surface, said button being electrically connected to said battery upon depression thereof for selectively energizing said cutting means.

12. A rechargeable shaver as in claim 7 wherein said actuating means comprises:

a hub extending from said base member adjacent said socket;

a bore extending through a bottom of said body portion, said hub extending through said bore when said male connector mates with said socket;

an electrical circuit including said battery and said cutting means;

a rod movably mounted in said bore and having an open position precluding a current delivery from said battery to said cutting means and a closed position for current delivery from said battery to said cutting means, said rod being at said open position upon said hub mating with said bore and at said closed position upon separation of said hub from said bore.

13. A rechargeable shaving apparatus for a vehicle, comprising:

a shaver, comprising:

a body portion having first and second ends and defining an interior cavity, said body portion having a tapered surface intermediate said first and second ends, said second end forming a generally circular surface normal to said body portion;

a shaving head at said first end of said body portion;

a rechargeable battery positioned within said interior cavity of said body portion and electrically connected to said shaving head;

a male connector electrically coupled to said battery and extending through said second end of said body portion;

means on said body for actuating said cutting means;

a recharging unit, comprising;

a base member adapted to hold said body portion, said base member including a socket for selectably mating with said male connector, said socket electrically connected to said battery;

an electrical connector assembly coupled to said base member for electrically connecting said socket with a vehicle power source for recharging said battery when said male connector is coupled to said socket;

wherein said base member includes:

a mounting bracket; and a holder pivotally attached to said mounting bracket, said holder including a bottom wall bounded by a rim about the circumference thereof, said rim having a configuration complementary to a configuration of said second end of said body portion for selectably retaining said second end within said rim.

14. A rechargeable shaving apparatus as in claim 13 wherein said electrical connector assembly comprises:

a cylindrical body adapted for insertion into an electrical receptacle in the vehicle;

a positive contact member extending from an operative end of said body;

a negative contact member extending from a side of said body;

a retention spring extending from an opposing side of said body; and a wire conductor extending from an opposite end of said body and coupled to said socket of said base member for electrically connecting said socket with said electrical receptacle when said body is inserted therein.

15. A rechargeable shaving apparatus as in claim 13 wherein said actuating means comprises a button positioned on said body portion adjacent said tapered surface, said button being electrically connected to said battery upon depression thereof for selectively energizing said shaving head.

16. A rechargeable shaving apparatus as in claim 13 wherein said actuating means comprises:

a hub extending from said base member adjacent said socket;

a bore extending through a bottom of said body portion, said hub extending through said bore when said male connector mates with said socket;

an electrical circuit including said battery and said shaving head;

a rod movably mounted in said bore and having an open position precluding a current delivery from said battery to said shaving head and a closed position for current delivery from said battery to said shaving head, said rod being at said open position upon said hub mating with said bore and at said closed position upon separation of said hub from said bore.

* * * * *